US008042613B2

(12) United States Patent
Hallundbaek et al.

(10) Patent No.: US 8,042,613 B2
(45) Date of Patent: Oct. 25, 2011

(54) DRILLING HEAD FOR REBORING A STUCK VALVE

(75) Inventors: Jørgen Hallundbaek, Graested (DK); Sven Karsten Jensen, Stenløse (DK); Thomas Sune Andersen, Helsingør (DK)

(73) Assignee: Weltec A/S, Allerod (DK)

( * ) Notice: Subject to any disclaimer, the term of this patent is extended or adjusted under 35 U.S.C. 154(b) by 0 days.

(21) Appl. No.: 12/528,035

(22) PCT Filed: Feb. 28, 2008

(86) PCT No.: PCT/DK2008/000084

§ 371 (c)(1),
(2), (4) Date: Nov. 17, 2009

(87) PCT Pub. No.: WO2008/104179

PCT Pub. Date: Sep. 4, 2008

(65) Prior Publication Data

US 2010/0101802 A1 Apr. 29, 2010

(30) Foreign Application Priority Data

Feb. 28, 2007 (DK) ..... 2007 00302

(51) Int. Cl.
*E21B 29/08* (2006.01)
*E21B 43/11* (2006.01)
*E21B 10/02* (2006.01)

(52) U.S. Cl. ..... 166/297; 166/55.2; 175/403; 408/68; 408/208; 408/214; 408/227

(58) Field of Classification Search ..... 166/297, 166/55.2, 55.6, 55.7; 175/403; 408/67, 68, 408/204, 206–208, 211, 214, 227
See application file for complete search history.

(56) References Cited

U.S. PATENT DOCUMENTS

| | | | | |
|---|---|---|---|---|
| 1,542,172 | A | 6/1925 | Warren et al. | |
| 2,643,858 | A * | 6/1953 | Hardman | 175/46 |
| 2,800,812 | A * | 7/1957 | Mueller et al. | 408/67 |
| 2,881,643 | A * | 4/1959 | Haade | 408/76 |
| 3,591,135 | A * | 7/1971 | Miller | 251/180 |
| 3,848,687 | A | 11/1974 | Funakubo | |
| 4,057,357 | A * | 11/1977 | Daghe et al. | 408/67 |
| 5,964,240 | A * | 10/1999 | Granovski | 137/15.13 |
| 6,206,616 | B1 * | 3/2001 | Smith et al. | 408/1 R |
| 6,378,629 | B1 * | 4/2002 | Baird | 175/75 |
| 6,588,517 | B2 * | 7/2003 | Baird | 175/75 |
| 6,599,063 | B1 | 7/2003 | Capstran | |
| 6,964,303 | B2 * | 11/2005 | Mazorow et al. | 166/298 |
| 7,357,605 | B2 * | 4/2008 | Weiler | 408/67 |
| 2003/0047315 | A1 * | 3/2003 | Allamon | 166/332.8 |

(Continued)

FOREIGN PATENT DOCUMENTS

GB 2207158 1/1989

(Continued)

*Primary Examiner* — Jennifer H Gay
(74) *Attorney, Agent, or Firm* — Cozen O'Connor

(57) ABSTRACT

A drilling head, method of drilling, and use of the drilling head, for reboring a stuck valve or drilling into the formation downhole and, in particular a drilling tool having a drilling head and a driving unit. The drilling head includes a hole saw beside a drill bit for cutting out a piece from the stuck valve. A drilling system includes the drilling tool and a driving tool for moving the drilling tool downhole.

22 Claims, 8 Drawing Sheets

U.S. PATENT DOCUMENTS

| | | | | |
|---|---|---|---|---|
| 2005/0279493 | A1* | 12/2005 | Marvel et al. | 166/105 |
| 2006/0188349 | A1* | 8/2006 | Weiler | 408/67 |
| 2007/0024217 | A1* | 2/2007 | Dodge | 318/108 |
| 2007/0297867 | A1* | 12/2007 | Weiler | 408/67 |
| 2008/0078553 | A1* | 4/2008 | George | 166/332.8 |
| 2010/0086372 | A1* | 4/2010 | Werner | 408/1 R |
| 2010/0101802 | A1* | 4/2010 | Hallundbaek et al. | 166/376 |

FOREIGN PATENT DOCUMENTS

| | | | | |
|---|---|---|---|---|
| JP | 2000081887 | A | * | 3/2000 |
| JP | 2007320019 | A | * | 12/2007 |
| JP | 2009136947 | A | * | 6/2009 |
| WO | WO 2007/084623 | | | 7/2007 |
| WO | WO 2008104179 | A2 | * | 9/2008 |

* cited by examiner

DRILLING HEAD FOR REBORING A STUCK VALVE

PRIORITY CLAIM

This is a U.S. national stage of application No. PCT/DK08/000084, filed on Feb. 28, 2008. Priority is claimed on the following application(s): Country: Denmark, Application No.: PA 2007 00302, Filed: Feb. 28, 2007, the content of which is incorporated here by reference.

TECHNICAL FIELD

The present invention relates to a drilling head for reboring a stuck valve or drilling into the formation downhole. The invention furthermore relates to a drilling tool comprising the drilling head and a driving unit; a drilling system comprising the drilling tool and a driving tool for moving the drilling tool downhole; a method of drilling; and a use of the drilling head.

BACKGROUND

Drilling tools are used when drilling a well in the subterranean formation. However, drilling may also be performed in an existing well for reboring a stuck valve or for taking out a sample of the formation.

U.S. Pat. No. 2,643,858 discloses a drilling tool for taking out a sample. For this purpose, the drilling tool is arranged with lifting fingers which are lowered for engaging the sample after this has been cut out. The disclosed drilling tool has a very complicated design for taking out the sample, where the arms may break or get stuck during a drilling operation.

Occasionally, a valve downhole which has been closed for some time gets stuck due to corrosion or the like, and thus cannot be reopened with normally used equipment. In such situations, reboring of the stuck valve is the only solution. When reboring the stuck valve, the drill bit tends to slide on the abutting surface, especially if the valve is a ball valve.

DESCRIPTION OF THE INVENTION

An aspect of the present invention is, at least partly, to overcome the disadvantages of the drilling tools mentioned above, and to provide an improved drilling head and thereby an improved drilling tool which is able to rebore a stuck valve or cut out a piece of the formation.

This aspect and the advantages becoming evident from the description below are obtained by a downhole drilling head for mounting onto a drilling tool for reboring a stuck valve or drilling into the formation downhole, comprising:

- a hole saw having a cylindrical body with a circumferential rim and a longitudinal axis going through a centre of the cylindrical body, and
- a drill bit extending along the longitudinal axis and through the centre of the cylindrical body, wherein the circumferential rim has at least one cutting edge rotating for cutting a piece out of the stuck valve or the formation.

In addition, the drill bit may have a retractable projection 34: when drilling in the valve, the projection is retracted when it is passed by the piece cut out by the cutting edge, the projection subsequently returning to its projected position, and the piece thus returning with the drilling bit when the drilling ends.

When the drill bit has a retractable projection, the piece which has been cut out is squeezed onto the projection and the projection is retracted for letting the piece pass the projection. The drilling power, i.e. the weight on bit (WOB), makes the piece press the projection into a retractable position. When the drilling process ends, the piece has slid past the projection and the projection returns to its un-retracted position. Thus, it is prevented that the piece slides off the drill bit, since the retractable projection retains the piece inside the hole saw and the piece thus is retracted together with the drilling head when the drilling process ends. The piece is no longer able to press the projection into a retracted position since the WOB only helps the piece onto the projection.

In another embodiment, the at least one cutting edge may incline at least partly towards the longitudinal axis of the cylindrical body. It is hereby obtained that the swarfs released when drilling into the valve are collected in the hole saw.

Furthermore, the circumferential rim may have at least three cutting edges distributed along the rim, preferably at least four cutting edges, more preferably at least six cutting edges, and even more preferably at least eight cutting edges.

In one embodiment, the cylindrical body may be at least partly hollow so as to receive the piece that is being cut out, the cylindrical body having a circumferential wall.

In another embodiment, the cutting edge may incline at least partly towards the longitudinal axis of the cylindrical body with an angle of 5°-60° in relation to the circumferential wall of the cylindrical body.

Furthermore, the cutting edge may incline at least partly towards the longitudinal axis of the cylindrical body so that a diameter (D) of the body decreases at least 2% forming a tip diameter (d) at a tip of the cutting edge.

Moreover, the retractable projection may have an inclining surface so that the piece can slide onto the projection during drilling.

In addition, the retractable projection may be retracted into a recess in a longitudinal shaft of the drill bit.

Advantageously, the retractable projection may be part of a partly circumferential collar having a gab, said collar partly surrounding the longitudinal shaft of the drill bit, whereby the projection is retracted by pressing one end of the collar towards another end of the collar, thus diminishing the gab.

In another embodiment, the retractable projection may be part of a collar surrounding the longitudinal shaft of the drill bit, the longitudinal shaft of the drill bit having a recess outside the projection into which recess the projection of the collar can be retracted and the collar being slit so that when the projections are pressed into the recess of the shaft, the slits are diminished and the projections can enter the recess of the shaft.

In one embodiment, the retractable projection is forced to return to its unretracted position due to the stiffness of the collar. However, in another embodiment, the retractable projection is forced to return to its unretracted position by means of a spring positioned in the recess of the shaft.

Furthermore, the cutting edge may constitute more than 5% of the circumferential rim, preferably more than 10% of the circumferential rim, and more preferably more than 25% of the circumferential rim.

In one embodiment, the cylindrical body may have an inner side abutting a circumferential edge of the piece when the piece has been cut out.

In another embodiment, the cylindrical body may have a closed end opposite the cutting edge.

In yet another embodiment, the circumferential rim may have a plurality of cutting edges.

The invention further relates to a drilling tool for drilling in a formation or the like downhole, comprising:

- a drilling head having at least one drill bit, and a driving unit for driving the drilling head, wherein the drilling head is provided on a shaft in connection with the driving unit and wherein the drilling tool further comprises a guide situated on the shaft for guiding the drill bit within a centre of a curvature, e.g. within a ball house of a ball valve downhole.

When drilling downhole for reboring a stuck valve, such as a ball valve, the drill bit has a tendency to slide on the spherical surface, thus being unable to drill through the valve. When having a guide, such as a cylindrical guide, the guide is able to fasten the drilling tool inside the ball valve so that the drilling head is fastened in relation to the stuck valve and thus is able to drill through the valve.

In one embodiment, the guide may be movably connected to the drilling head for translation of the drilling head in relation to the guide during drilling.

In another embodiment, the guide may have a cylindrical, encircling wall surrounding the hole saw when the hole saw is in its initial position before drilling.

In yet another embodiment, the guide of the cylindrical wall may have at least one slot.

Furthermore, the drilling head may be a drilling head according to any of the abovementioned embodiments.

In addition, the invention relates to a method for reboring a stuck valve downhole, comprising the steps of:

positioning the drilling head outside the valve downhole, drilling with the drilling head mentioned above by penetrating the valve with the drill bit, with the drilling head in a first position, and subsequently penetrating the valve with the hole saw in a circumference of the first position so that a piece of the valve is cut out of the stuck valve, collecting shavings in the hole saw while drilling, retracting the drilling head and the piece of the valve held within the hole saw retained by the drill bit.

Moreover, the invention relates to a use of the above mentioned downhole drilling head for reboring a stuck valve, for drilling into the formation downhole, or for taking out a sample of the formation downhole.

Finally, the invention relates to a drilling system for drilling downhole, comprising any one of the above-mentioned drilling tools, and a driving tool such as a downhole tractor for moving the drilling tool in the well.

BRIEF DESCRIPTION OF THE DRAWINGS

The invention is explained in detail below with reference to the drawings, in which.

The drawings are merely schematic and shown for an illustrative purpose.

DETAILED DESCRIPTION OF THE INVENTION

Figure 1:
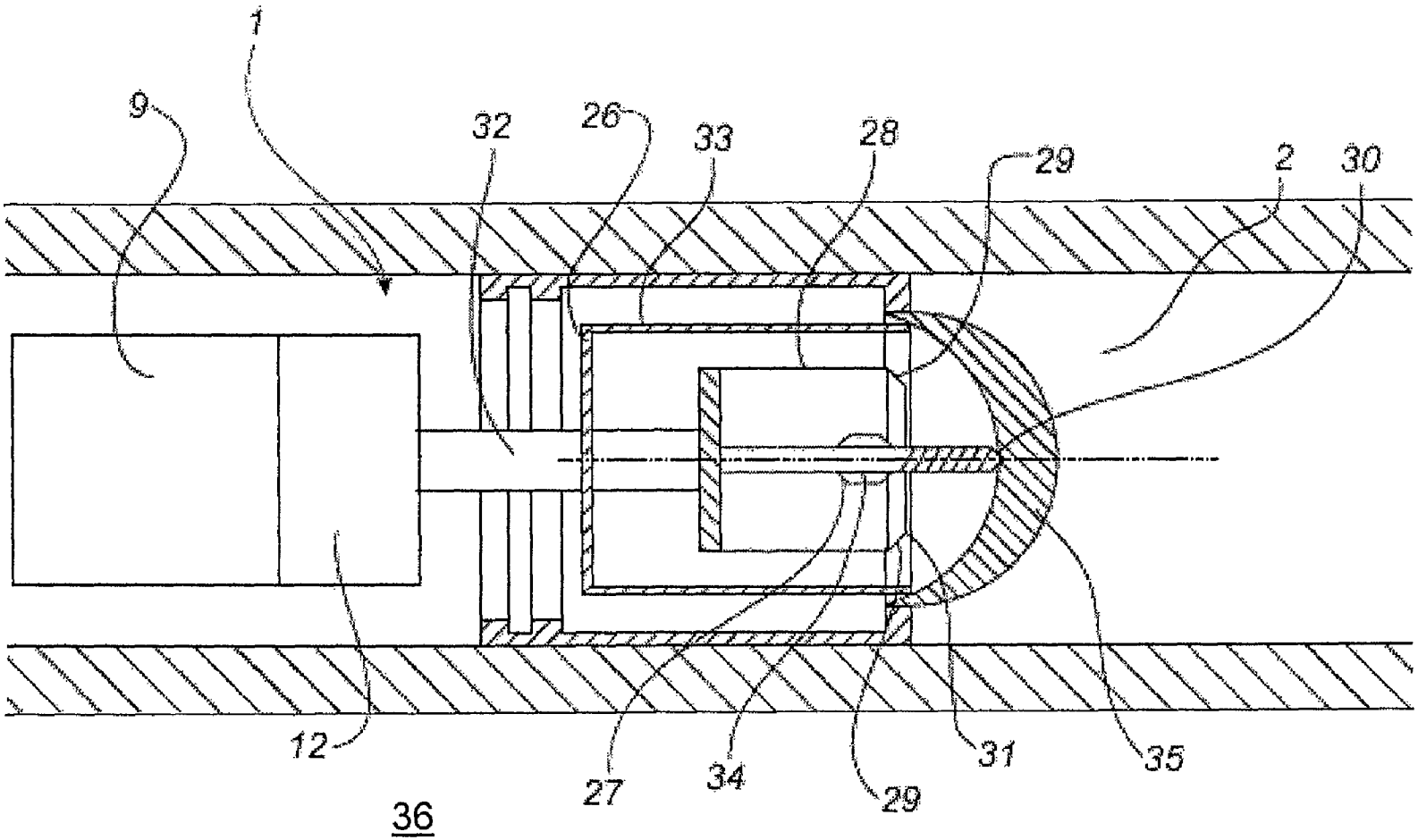
FIG. 1 shows a drilling tool according to the invention.

FIG. 1 shows a downhole drilling tool 1 according to the present invention comprising a downhole drilling head 2 and a driving unit 9. The downhole drilling head 2 is rotationally driven by the driving unit 9 at a certain speed and at a certain weight on bit (WOB) so that the longitudinal displacement of the bit 10 and 30 towards e.g. the formation 36 or a valve 35 remains constant during the drilling process.

In the embodiment shown in FIG. 1, the downhole drilling head 2 has an elongated drill bit 30 situated in the middle of a hole saw 28. The hole saw 28 has a cylindrical and, at least partly, hollow body with a circumferential rim 29 and a longitudinal axis going through a centre of the cylindrical body. The longitudinal axis is shown as a dotted line.

In another embodiment, the circumferential rim 29 is equipped with a plurality of cutting edges 31, making the drilling process more efficient than when using only one cutting edge 31 as may be the case in another embodiment.

As shown in FIG. 1, the downhole drilling head 2 is provided on a shaft 32 in connection with a driving unit 9. The tool further comprises a guide 33 situated on the shaft 32 and the guide 33 is movably connected to the downhole drilling head 2 for translation of the drilling head 2 in relation to the guide 33 during drilling.

The guide 33 is here shown as a cylinder wall surrounding the hole saw 28. The circumferential edge of the cylindrical guide 33 is able to guide the hole saw 28 within a curvature, e.g. within a ball house of a ball valve 35 downhole. In this way, the drill bit 30 is forced to abut the curved inside wall of the ball valve 35 and the bit 30 is thus able to drill through the ball valve 35 for reboring the valve 35.

Figure 7:
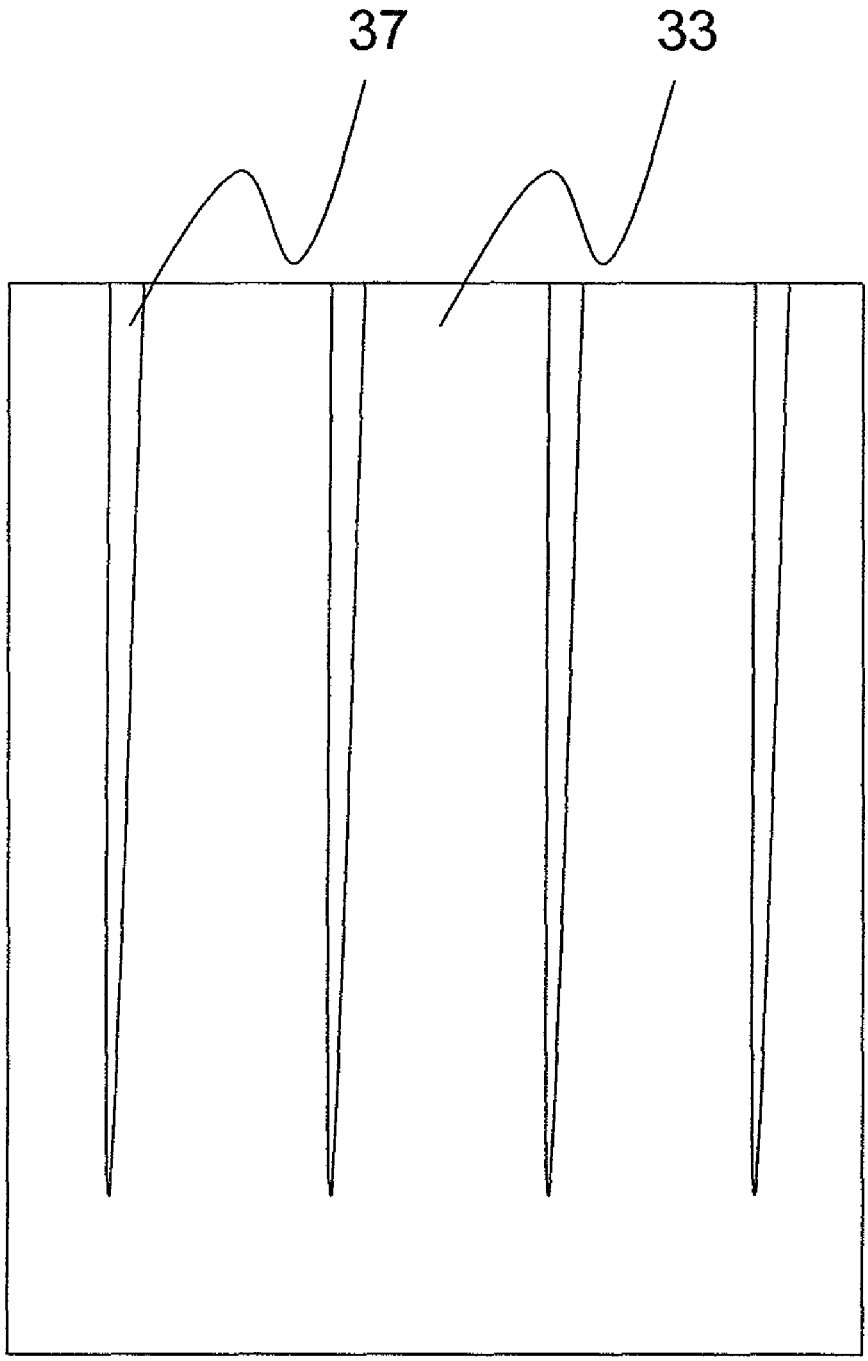
FIG. 7 shows the slots or cut-out pieces in the guide.
Figure 8:
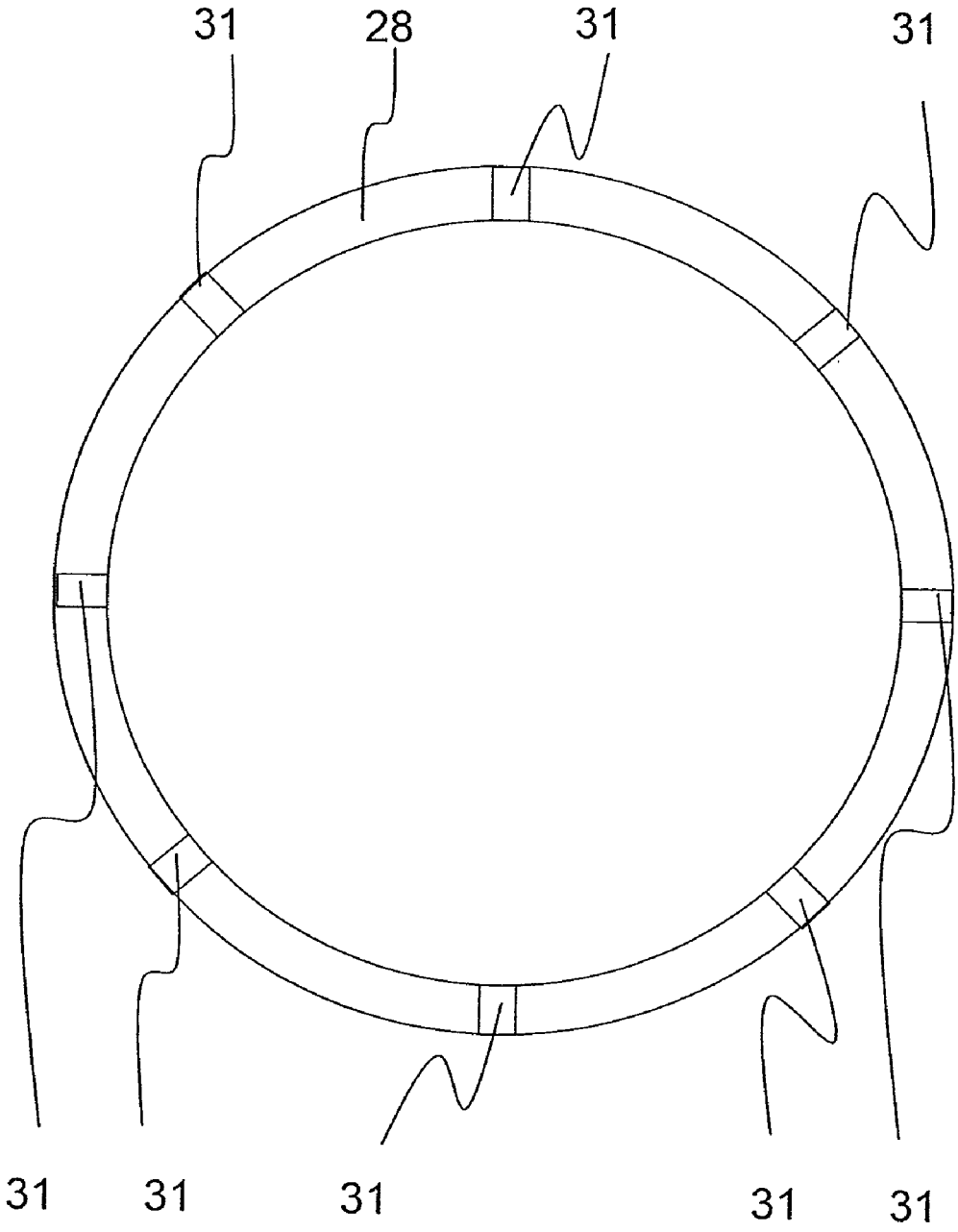
FIG. 8 shows a top view of the retractable projection of FIG. 1 in accordance with another embodiment, showing eight cutting edges.

In another embodiment, the guide 33 is merely two pins on each side of the drill bit 30. As shown in FIG. 7, the guide may also be a slotted cylindrical wall, making the guide 33 somewhat resilient so as to fit into the valve 35, the formation 36, or the like which needs to be cut out.

The drill bit 30 drills into the valve and the cutting edge 31 cuts a piece 37 off the valve 35 or the formation 36 in a circumferential cut around the drill bit 30. The piece 37 is fastened onto the drill bit 30 while drilling through the piece 37, and after termination of the drilling process, the drilling head 2 returns to its initial position with the cut piece 37 inside.

The hole saw 28 is hollow and has a closed end opposite the cutting edge 31 forming a hollow cavity in which a piece 37 cut out of the formation of the stuck valve 35 can be received. This hollow cavity allows all swarfs from the drilling process to be collected and taken above surface when the piece 37 cut out is to be released from the hole saw 28.

Figure 6:
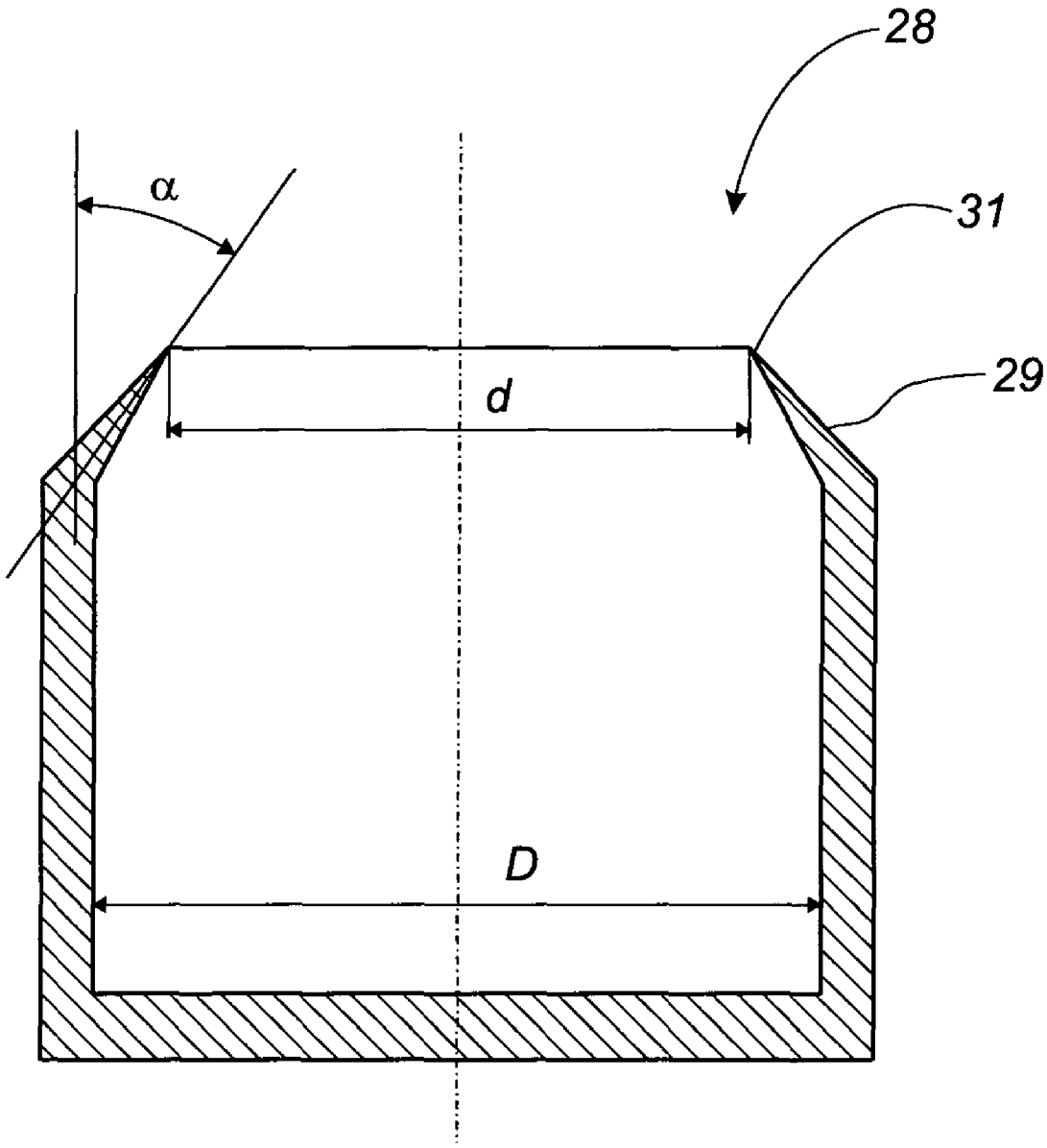
FIG. 6 shows the hole saw with an inclined cutting edge.

The drill bit 30 extends along the longitudinal axis and through the centre of the cylindrical body. The circumferential rim 29 has two cutting edges 31 inclining towards the longitudinal axis of the cylindrical body. As can be seen from FIG. 6, the cutting edges 31 incline towards the longitudinal axis at an angle a of approximately 45° in relation to the circumferential wall of the hole saw 28. In another embodiment, the angle a may vary between 5° and 80°, such as between 15° and 55°.

Because the circumferential rim 29 inclines towards the longitudinal axis, the diameter D of the hole saw 28 decreases to a tip diameter d at the tip of the cutting edge. The diameter D decreases between 2% and 20%, such as 5%-10%.

By having a cutting edge 31 that inclines towards the longitudinal axis of the hole saw 28, the swarfs from the drilling process are directed into the hollow cavity of the hole saw 28. Furthermore, the piece 37 cut out from the formation 36 or the stuck valve 35 will close the cavity created inside the hollow body at the closed end 26. Thus, the swarfs are safely transported above surface and a second process of removing the swarfs is no longer needed.

In order to collect swarfs or pieces cut off from the valve or the formation more efficiently, the inclining part 27 of the cutting edge may constitute more than 5% of the circumference of the circumferential rim, preferably more than 10% of the circumference, and more preferably more than 25% of the circumference. In this way, when the drilling head is retracted after a drilling operation, the piece of the valve which has been cut out will be more successfully retracted into the drilling head.

In FIG. 1 and FIGS. 5*a-d*, the drill bit 30 is provided with a retractable projection 34 so that the piece 37 may be further fastened when the drilling head 2 returns to its initial position. The projection 34 retracts into a recess in a longitudinal shaft of the drill bit 30 when the piece 37 cut out by the cutting edge 31 is forced past the projection 34 into the hollow cavity of the drilling head 2 and maintained there when the projection 34 subsequently returns to its projected position.

The projection 34 may comprise any kind of retractable means, such as a spring, and due to the sloping design of the projection 34, the piece 37 slides onto and past the projection 34. By sliding onto the projection 34, the piece 37 presses the projection 34 into a retracted position and the spring means forces the projection 34 back again when the piece 37 has passed.

In another embodiment, the retractable projection 34 is part of a collar surrounding the longitudinal shaft of the drill bit. The longitudinal shaft has a recess outside the projection into which recess the projection of the collar can be retracted. The collar is slid along the longitudinal extension of the collar and gabs occur at the middle of the collar. When the projections are pressed so as to be retracted into the recess of the shaft, the projections can thus enter the recess of the shaft.

In yet another embodiment, the retractable projection 34 is part of a collar having a gab along the longitudinal extension of the collar so that the collar can be adjusted into a smaller diameter by pressing its ends closer towards one another whereby the gab is decreased.

The recess in the longitudinal shaft may have any kind of cross-sectional shape along the longitudinal axis of the shaft, such as a square, a trapezoid shape, a semi-circle, etc.

Figure 5A:
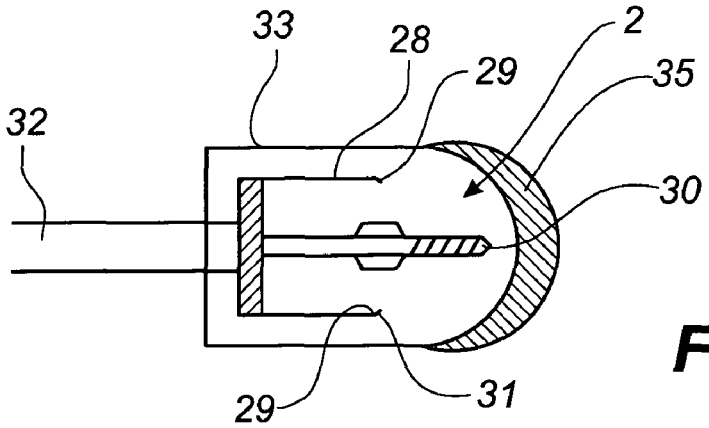
Figure 5B:
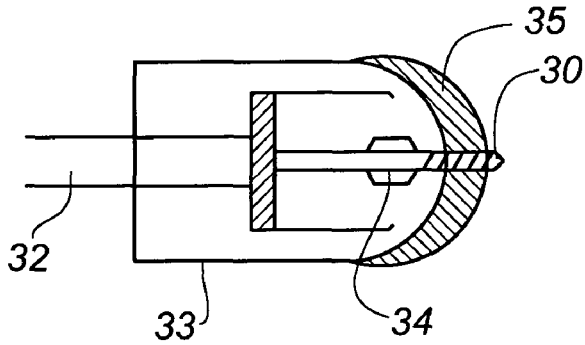
Figure 5C:
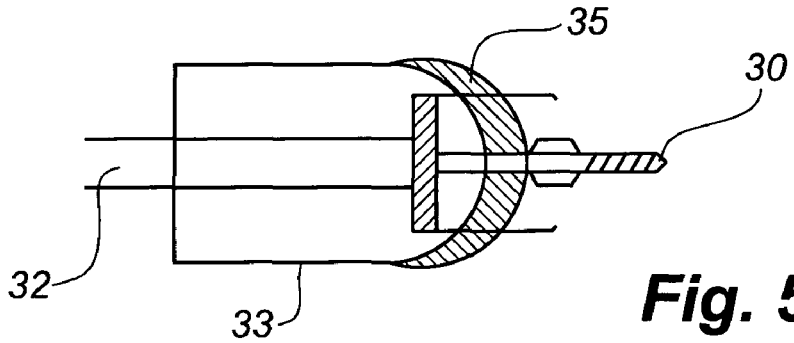
Figure 5D:
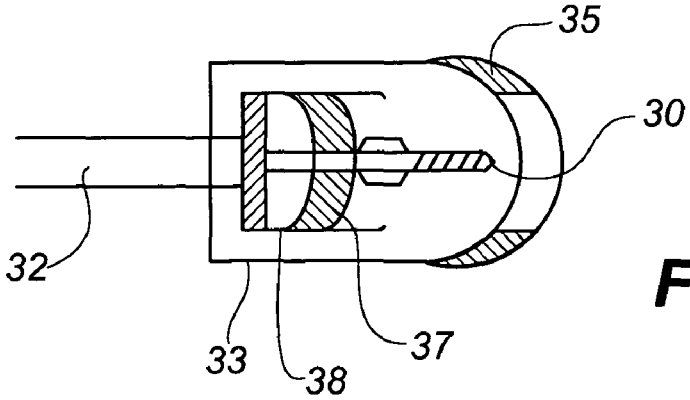

In FIG. 5*a*, the drilling head 2 of FIG. 1 is shown in its first position where the guide 33 has guided the drilling head 2 into drilling position in the curved inside surface of a stuck valve 35. In FIG. 5*b*, the drill bit 30 has drilled its way through the stuck valve 35 while the guide 33 maintains its position abutting the inside surface of the ball valve 35. In this way, the drill bit 30 has been moved longitudinally in relation to the guide 33. In FIG. 5*c*, the piece 37 has passed the projection 34 of the drill bit 30 and has thus forced the projection 34 to retract itself. Subsequently, the drilling head 2 is retracted into its initial position after termination of the drilling process as shown in FIG. 5*d*. When the drilling head 2 is retracted, the piece 37 is retracted as well. The circumferential edge of the piece 37 abuts the inside of the cylindrical wall of the hole saw 28 thus forming a cavity together with the closed end of the hole saw 28. Due to the inclined design of the cutting edge 31, released swarfs are forced into the curved surface of the valve 35 and the hollow cavity of the hole saw 28 when the piece 37 is retracted. Thus, the swarfs are collected in the cavity and no subsequent cleaning process is needed for cleaning up such swarfs from the well.

Figure 2:
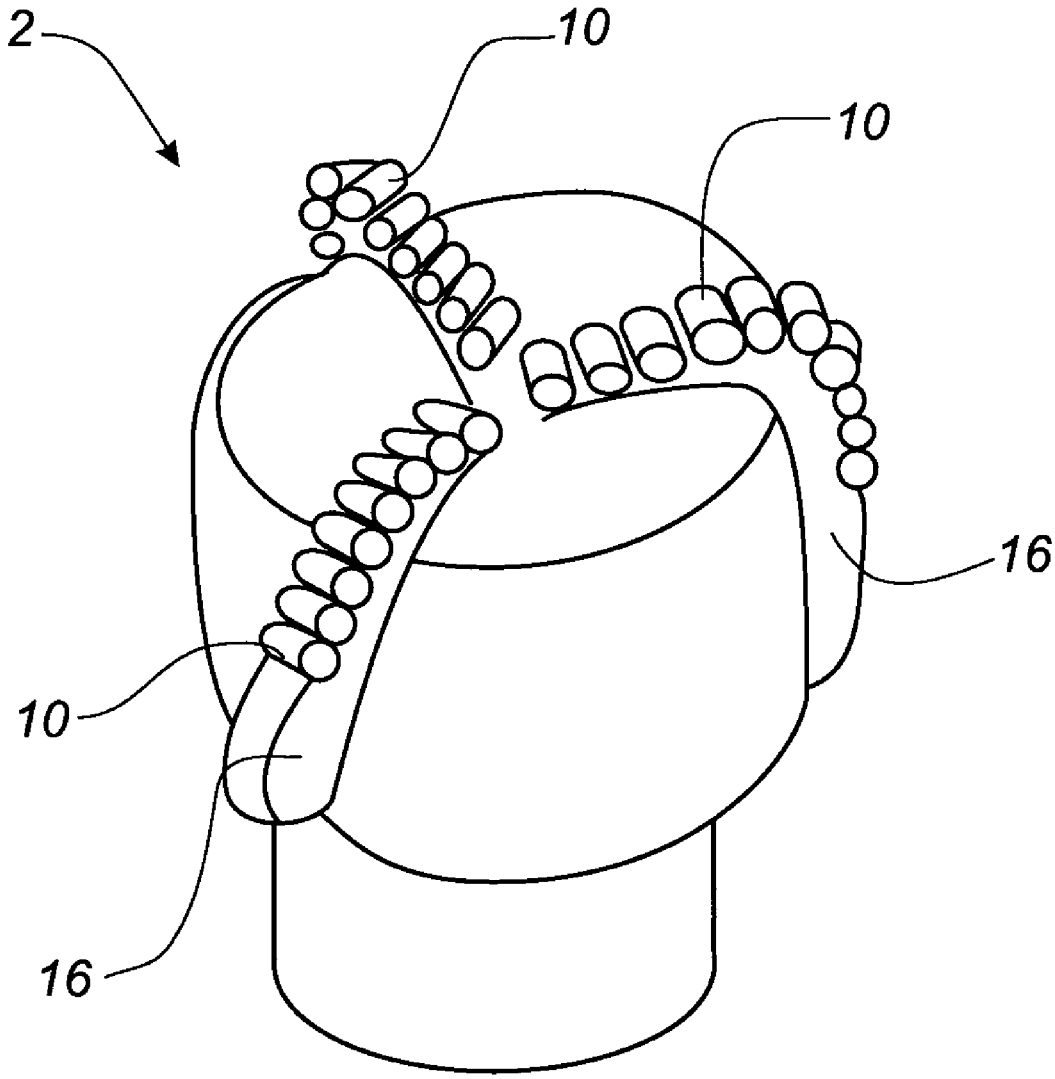
FIG. 2 shows one embodiment of the drilling head.
Figure 3:
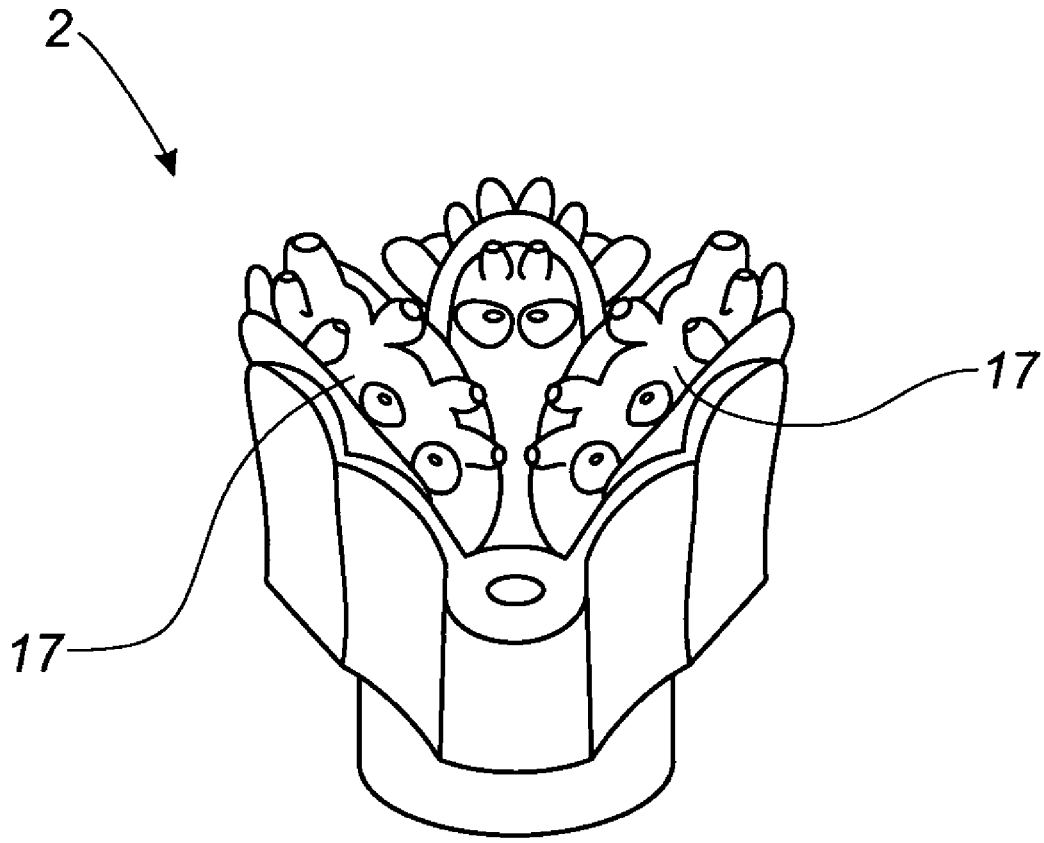
FIG. 3 shows another embodiment of the drilling head.
Figure 4:
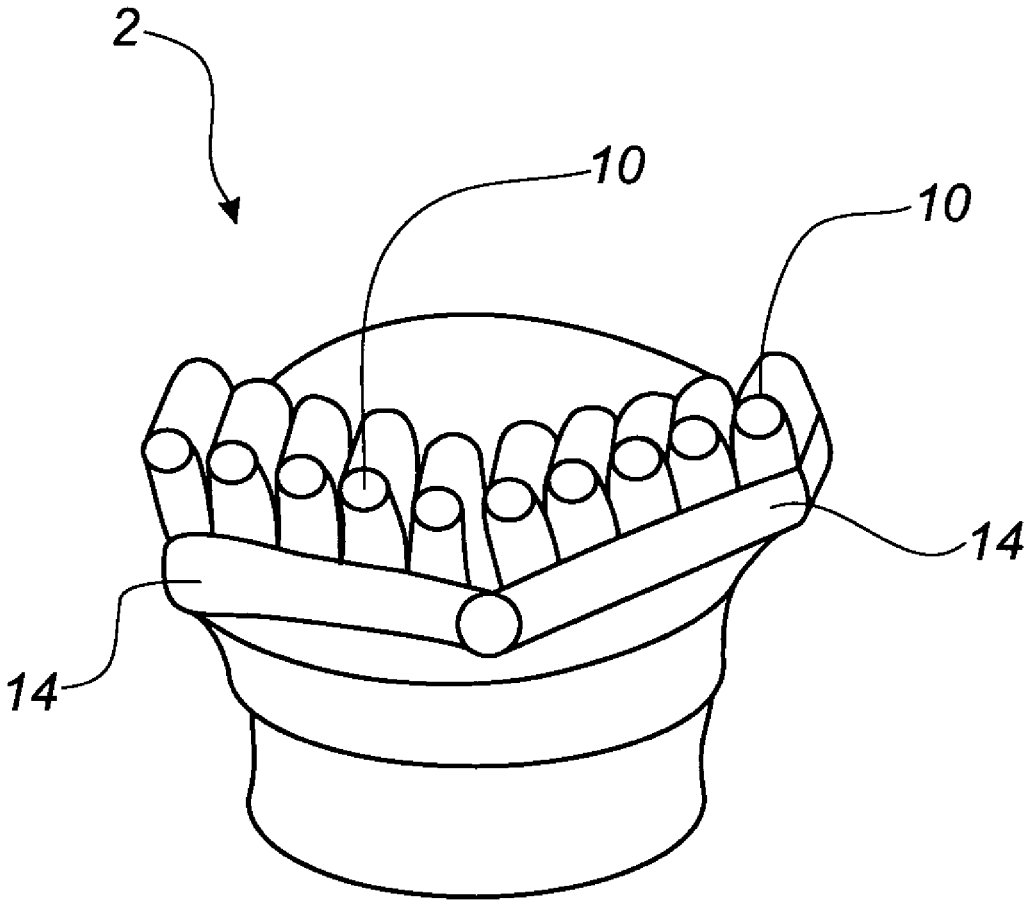
FIG. 4 shows an additional embodiment of the drilling head, FIG. 5 *a-d* shows a partial view of the drilling tool of FIG. 1, showing a drilling head before, during, and after drilling.

According to the invention, the drilling head 2 may be any type of drilling head 2. Some other examples are shown in FIG. 2-4. In the embodiment shown in FIG. 2, the drilling head 2 has three rows 16 of bits 10, the head 2 on which the rows 16 are situated rotating in order for the bits 10 to cut swarfs off the formation. In another embodiment, shown in FIG. 3, the drilling head 2 has three wheels 17 with a plurality of bits 10, the wheels 17 rotating in relation to one another during drilling. In yet another example of a drilling head 2 shown in FIG. 4, the drilling head 2 has two arms 14 with a plurality of bits 10, the arms 14 rotating while drilling.

The driving unit 9 is an electrical motor which drives the drilling head 2. The motor has a shaft 32 for driving the drilling head 2. The shaft 32 may be connected to the drilling head 2 through a gear connection 12. In this way, one drilling head 2 may be replaced by another drilling head 2.

In order to increase the drilling efficiency, outlets may be positioned in the drilling head 2 so that the fluid is ejected in order to tear off swarfs from the formation 36 and flush the swarfs away from the drilling head 2.

For ejection of fluid, the drilling tool 2 may comprise a pump which may be any kind of suitable pump. In this embodiment, the pump is a one-step centrifugal pump, but in another embodiment the pump may be a multi-step centrifugal pump, a jet pump, or a piston pump.

In the event that the drilling tool 2 is not submergible all the way into the casing, a downhole tractor can be used to push the drilling tool 2 all the way into position in the well. A downhole tractor is any kind of driving tool capable of pushing or pulling tools in a well downhole, such as a Well TRACTOR®.

The invention claimed is:

1. A downhole drilling head, comprising:

a hole saw having a cylindrical body with a circumferential rim and a longitudinal axis going through a centre of the cylindrical body, and a drill bit extending along the longitudinal axis and through the centre of the cylindrical body, wherein the circumferential rim has at least one cutting edge inclining at least partly towards the longitudinal axis of the cylindrical body, and wherein the cutting edge is rotatable and capable of cutting a piece out of at least one of a stuck metal valve or a formation downhole, and wherein the cutting edge inclines at least partly towards the longitudinal axis of the cylindrical body so that an inner diameter (D) of the body decreases at least 2% forming a tip diameter (d) at a tip of the cutting edge.

2. The downhole drilling head according to claim 1, wherein the drill bit has a retractable projection; when drilling, the projection is retracted when the projection is passed by the piece cut out by the cutting edge, the projection subsequently returning to a projected position, and the piece thus returning with the drilling bit when the drilling ends.

3. The downhole drilling head according to claim 1, wherein the circumferential rim has at least three cutting edges distributed along the rim.

4. The downhole drilling head according to claim 3, wherein the circumferential rim has at least four cutting edges distributed along the rim.

5. The downhole drilling head according to claim 4, wherein the circumferential rim has at least six cutting edges distributed along the rim.

6. The downhole drilling head according to claim 5, wherein the circumferential rim has at least eight cutting edges distributed along the rim.

7. The downhole drilling head according to claim 1, wherein the cutting edge constitutes more than 5% of the circumferential rim.

8. The downhole drilling head according to claim 7, wherein the cutting edge constitutes more that 10% of the circumferential rim.

9. The downhole drilling head according to claim 8, wherein the cutting edge constitutes more that 25% of the circumferential rim.

10. A drilling tool comprising the downhole drilling head of claim 1.

11. A downhole drilling head, comprising:

a hole saw having a cylindrical body with a circumferential rim and a longitudinal axis going through a centre of the cylindrical body, and a drill bit extending along the longitudinal axis and through the centre of the cylindrical body, wherein the circumferential rim has at least one rotatable cutting edge capable of cutting a piece out of a stuck valve or a formation downhole, and wherein the drill bit has a retractable projection; when drilling, the projection is retracted when the projection is passed by the piece cut out by the cutting edge, the projection subsequently returning to a projected position, and the piece thus returning with the drilling bit when the drilling ends, wherein at least a part of the retractable projection is located within the cylindrical body of the hole saw.

12. The downhole drilling head according to claim 11, wherein the retractable projection has an inclining surface so that the piece can slide onto the projection during drilling.

13. The downhole drilling head according to claim 11, wherein the retractable projection is retracted into a recess in a longitudinal shaft of the drill bit.

14. A drilling tool comprising the downhole drilling head of claim 11.

15. A drilling tool for drilling in a ball house of a ball valve downhole, comprising:

a drilling head according to claim 1, and a driving unit for driving the drilling head, wherein the drilling head is provided on a shaft in connection with the driving unit and wherein the drilling tool further comprises a guide situated on the shaft for guiding the drill bit within a centre of a curvature.

16. The drilling tool according to claim 15, wherein the guide is movably connected to the drilling head for translation of the drilling head in relation to the guide during drilling.

17. The drilling tool according to claim 15, wherein the guide has a cylindrical, encircling wall surrounding the hole saw when the hole saw is in an initial position before drilling.

18. The drilling tool according to claim 15, wherein the cylindrical wall of the guide has at least one slot.

19. A drilling system for drilling downhole, comprising a drilling tool according to claim 15, and a driving tool for moving the drilling tool in the well.

20. A method for reboring a stuck valve downhole, comprising the steps of:

positioning the drilling head outside the valve downhole, drilling with the drilling head according to claim 1 by penetrating the valve with the drill bit, with the drilling head in a first position, and subsequently penetrating the valve with the hole saw in a circumference of the first position so that a piece of the valve is cut out of the stuck valve, collecting shavings in the hole saw while drilling, retracting the drilling head and the piece of the valve held within the hole saw retained by the drill bit.

21. A method for drilling into a formation downhole, the method comprising:

positioning the drilling head outside the formation downhole, drilling with the drilling head according to claim 1 by penetrating the formation with the drill bit, with the drilling head in a first position, and subsequently penetrating the formation with the hole saw in a circumference of the first position so that a piece of the formation is cut out of the formation, collecting shavings in the hole saw while drilling, and retracting the drilling head and the piece of the valve held within the hole saw retained by the drill bit.

22. A method for cutting out a sample downhole, the method comprising:

positioning the drilling head outside the location of sampling downhole, drilling with the drilling head according to claim 1 by penetrating the location of sampling with the drill bit, with the drilling head in a first position, and subsequently penetrating the location of sampling with the hole saw in a circumference of the first position so that a piece of the location is cut out of the location of sampling, collecting shavings in the hole saw while drilling, and retracting the drilling head and the piece of the valve held within the hole saw retained by the drill bit.

* * * * *